United States Patent [19]

Brewer

[11] 4,168,022

[45] Sep. 18, 1979

[54] HARNESS WITH SEPARATE, ADJUSTABLE CAMERA HOLDER

[76] Inventor: Robert A. Brewer, 15 Castle Park Way, Oakland, Calif. 94611

[21] Appl. No.: 868,077

[22] Filed: Jan. 9, 1978

[51] Int. Cl.[2] ..... A45F 5/00

[52] U.S. Cl. ..... 224/257; 224/908

[58] Field of Search ..... 224/5 V, 1 A, 5 R, 58, 224/49, 54, 27, 28 A, 26 K, 26 R, 55, 56, 57, 5 W, 5 BC, 5 A, 5 B, 5 E, 5 F, 5 H, 5 P, 26 B, 1 R

[56] References Cited

U.S. PATENT DOCUMENTS

| | | | |
|---|---|---|---|
| 946,850 | 1/1910 | Tabler | 224/55 |
| 2,480,129 | 8/1949 | Gebler | 224/1 A |
| 3,266,464 | 8/1966 | Davis | 224/28 A X |
| 3,526,347 | 9/1970 | Kuban | 224/5 V |

FOREIGN PATENT DOCUMENTS

| | | | |
|---|---|---|---|
| 38520 | 3/1928 | Denmark | 224/55 |
| 1228617 | 8/1960 | France | 224/55 |
| 293339 | 7/1928 | United Kingdom | 224/28 R |

OTHER PUBLICATIONS

Photography (magazine), Apr. 1976, p. 132, "Kuban Hitch."

*Primary Examiner*—Robert J. Spar
*Assistant Examiner*—Jerold M. Forsberg
*Attorney, Agent, or Firm*—James R. Cypher

[57] ABSTRACT

A flexible, non-elastic strap harness for carrying cameras and other portable instruments having a separate adjustable instrument grip which includes a flexible instrument encircling holding member and a sliding grip member for adjusting the length of said holding member.

7 Claims, 14 Drawing Figures

HARNESS WITH SEPARATE, ADJUSTABLE CAMERA HOLDER

BACKGROUND OF THE INVENTION:

Amateur and professional photographers who wish to carry their cameras while engaging in active sports such as skiing, mountain climbing, cycling, river rafting, hunting or boating must use some device to secure the camera closely to their bodies. Zimmerman, U.S. Pat. No. 3,305,148 provided a special snap coupling device which threadably attached to the camera and was looped about a chest belt. Zimmerman's method did not relieve the fatique of the weight of the camera being bourne by the person's neck by the standard neck strap nor did it securely hold the camera in a fixed position.

Kuban, U.S. Pat. No. 3,526,347 taught the use of elastic straps which caused the shoulders to take the weight of the binoculars but the elastic straps permitted the binoculars to bounce annoyingly under strenuous activities such as running, riding, and skiing. Unless the elastic straps were extremely tight, the binoculars could easily slip out from under the elastic chest band. A metal coupling joining the ends of the chest band was a source of damage to the finish of the binoculars.

The Kuban-Hitch, trademark, an unpatented harness, similar to U.S. Pat. No. 3,526,347 replaced the elastic straps with flexible inelastic straps and added an adapter consisting of a pair of metal end plates for carrying a plurality of rubber bands. The Kuban-Hitch is generally only used for holding the camera cases with the camera inside. The camera case or other instrument is enmeshed by the rubber bands. While the Kuban-Hitch, holds the camera more securely than the hitch taught in the Kuban U.S. Pat. No. 3,526,347, it does not limit the camera from bouncing back and forth against the chest due to the rubber bands connecting the ends of the harness. Further, there is no positive holding of the camera and as the rubber bands stretch and lose their elasticity, the holding function of the device deteriorates. Further, if the camera is small, the device will not hold the camera unless additional rubber bands are twisted about the camera, making it difficult to quickly remove it from a held position to a camera ready position.

Brewer, U.S. Pat. No. 3,884,403, taught the use of a flexible, inelastic harness which eliminates camera bounce and introduced a truly quick release Velcro attachment means. The Velcro attachment, however, required the use of adhesive on the backs of the cameras, which some with expensive cameras objected to.

Brewer, U.S. Pat. No. 4,033,488, introduced a quick release attachment which gave the sportsman a new level of security without permanently attaching any object to the camera. The attachment, however, proved expensive to make and subject to loss if detached from the camera and not carefully stored in a camera bag.

Brewer, U.S. Pat. No. 4,048,242 represents the ultimate in camera security but is even more expensive than previous devices and it too is subject to loss if not carefully stored. Further, the previous Brewer devices permitted the camera to tilt forwardly.

SUMMARY OF THE INVENTION

The present invention incorporates the camera or other instrument gripping means in the harness strap itself. For the first time, there is no extra attachment to manufacture which can become detached from the harness strap and mislaid between usages.

The present invention gives the same ultimate non-bounce camera retention as previous Brewer harnesses but dramatically decreases the cost of the camera attachment means.

Another feature of the present invention is the fact that there are no metal parts in the camera holding or gripping means which can scratch or mar the lenses or finish on fine cameras or damage the mechanical parts.

A further advantage of the invention is the reduction in weight of the harness and grip over all of the prior art devices.

Still another feature is the fact that the camera can be quickly and easily detached from the harness holding means and then reattached after using the camera to take a picture.

A truly surprising feature of the present invention is the fact that the camera holding means will hold the camera more securely than the Kuban-Hitch, trademark, without the relatively heavy metal parts and virtual maze of rubber bands; substituting a simple fabric or cord loop and a simple sliding loop closure.

Another feature not present in any of the prior art devices is the fact that the weight of the camera itself not only causes the camera to be held more closely to the body by the chest strap, but the camera weight also causes a tensioning of the chart strap which in turn causes the camera gripping means to grip the camera more tightly in a positive and non-elastic grip.

The present device is the most compact positive grip harness ever to be produced.

Finally, the device of the present invention holds the camera, not just the case; it holds cameras with telescoping lenses attached to the camera and in the horizontal, not a tilted position.

DESCRITION OF THE PREFERRED EMBODIMENTS

Figures 1, 2, 3, 4, 5, 11, 12, 13, 14:
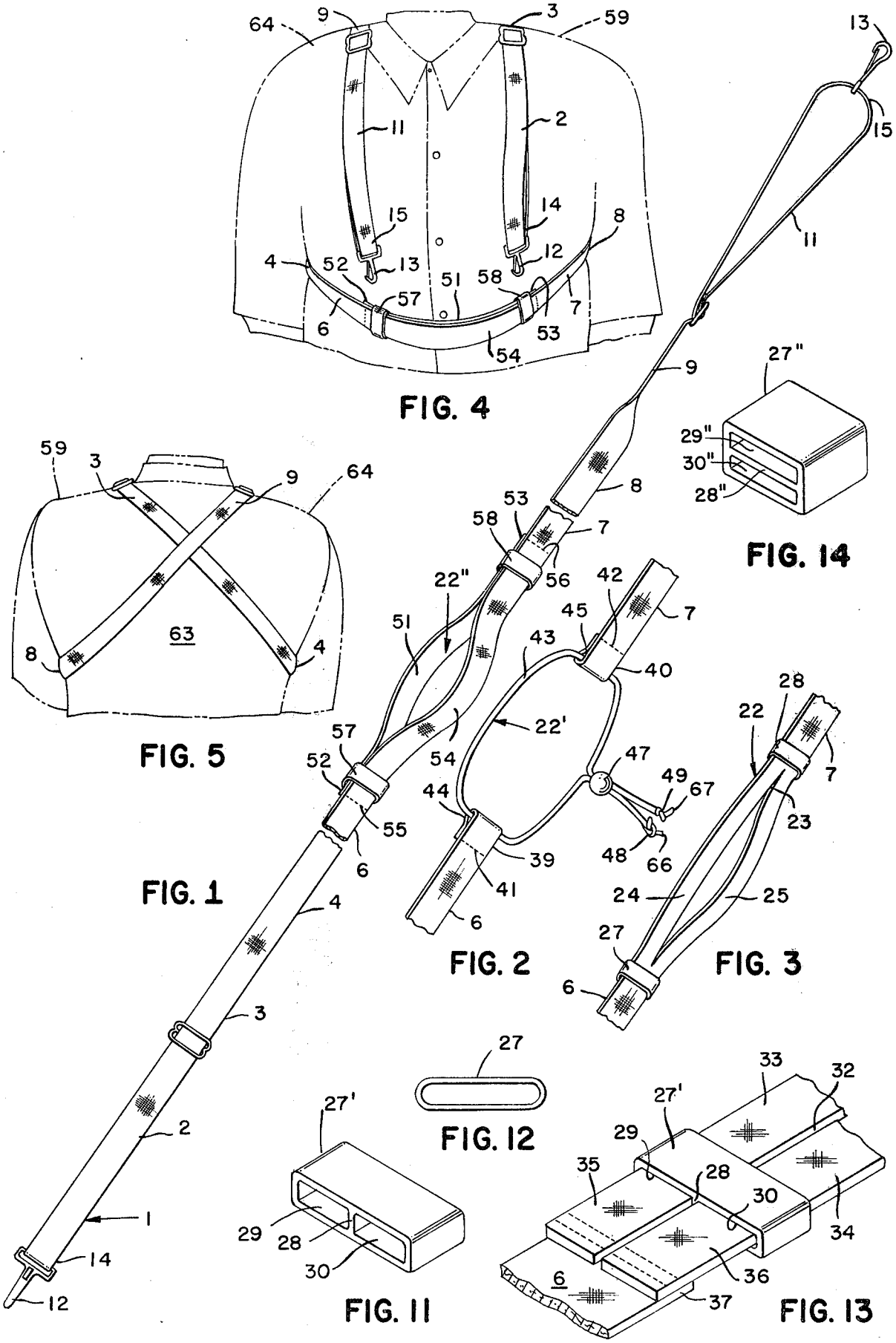
FIG. 1 is a plan view of the harness and instrument holder of the present invention.
FIG. 2 is a plan view of an alternate holding means which may be used with the harness strap of FIG. 1.
FIG. 3 is a plan view of an alternate holding means which can also be used with the harness of FIG. 1.
FIG. 4 is a front view of the harness of FIG. 1 illustrating the manner in which the harness is worn.
FIG. 5 is a back view of the harness shown in FIG. 4.
FIG. 11 is a perspective view of a slide member of the type shown in FIG. 13.
FIG. 12 is a side view of the slide shown in FIG. 3.
FIG. 13 is a perspective view of a portion of an alternate form of holding means.
FIG. 14 is a perspective view of another form of slide fastener of the type that may be used with the harness illustrated in FIG. 1.

The camera carrying and holding system of the present invention is described and illustrated in three alternative forms in this specification. The flexible, non-elastic elongated member is identical in all three forms and like parts carry identical numbers. The non-elastic member 1, common to all of the forms consists of the following portions and has a length adapted to span the distance from the wearer's chest (first chest portion 2, over one shoulder) (first shoulder portion 3), under the arm, (first under arm portion 4), across the chest (transverse chest portion 6 and 7), under the second arm (second under arm portion 8), over the second shoulder (second shoulder portion 9) and back to the chest (second chest portion 11). A pair of releasable coupling members 12 and 13 are attached to the first and second ends 14 and 15 of the strap and are dimensioned to releasably couple to the apertured coupling elements 17 and 18 on the camera 19. The harness of the present invention is particularly suited for cameras having a lens barrel 21, telescoping lens or other tubular front projecting protrusion.

Figure 9:
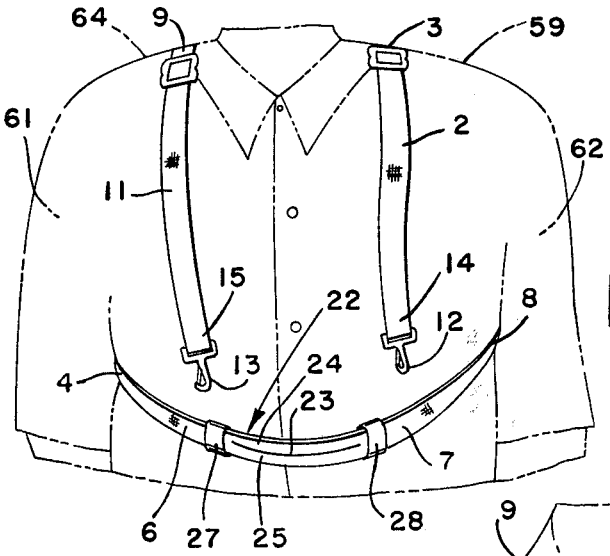
FIG. 9 is a front view of the harness and holding means of FIG. 3 illustrating the manner in which the harness is worn.
Figure 10:
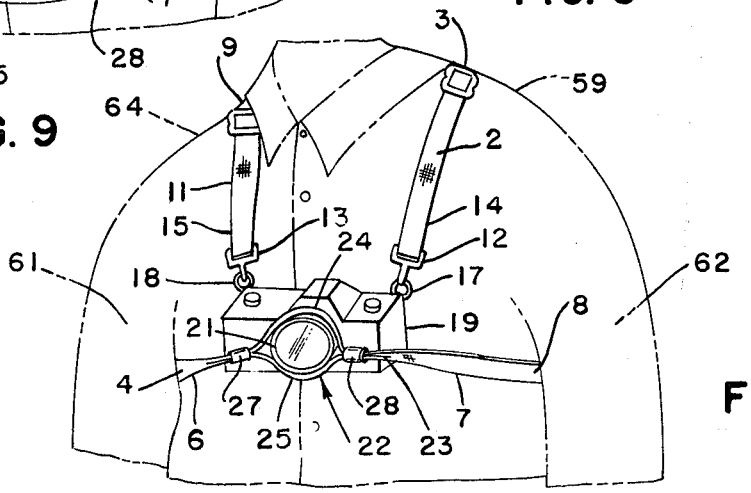
FIG. 10 is a front view of the harness and holding means shown in FIG. 9 attached to a camera.

Referring to FIGS. 3, 9 and 10, the holding means 22 connected to the transverse chest portion adapted for encircling the barrel of the camera includes an elongated slit 23 in the transverse chest portion. The slit should be approximately 9 inches long. (22.86 cm.) The transverse chest portion of the strap is divided into strap portions 24 and 25 which are preferably equal in width.

The slide means is connected to the holding means for selectively adjusting the diameter of the opening of the holding means encircling the camera barrel. Referring to FIGs. 3, 9, 10 and 12 the slide means includes a slide member 27 mounted on the transverse chest portion for sliding movement thereon. Preferably, a second slide member 28 is mounted on the transverse chest portion. The slide may be constructed from plastic with an inside cross sectional area which is equal or slightly less than the outside cross sectional area of the transverse chest portion so that the slide will be frictionally retained on the transverse portion where it is placed.

A slightly different optional slide 27' is shown in FIGS. 11 and 13. The slide may be made of plastic and includes a septum member 28 which divides the inside opening into two separate compartments 29 and 30. In use, the slide is used with the holding means illustrated in FIGS. 3 and 13. The septum is placed through slot 23 of FIG. 3 or in the space 32 between straps 33 and 34 of FIG. 13. The purpose of the septum is to prevent the slide members from moving along the harness trap beyond the slit portion or the double straps 33 and 34 of FIG. 13. As shown in FIG. 13, the straps 33 and 34 are attached as by sewing the ends 35 and 36 to the end 37 of the transverse chest portion 6 of the harness. The two straps are attached in like manner to the other end of the transverse chest portion.

Figure 7:
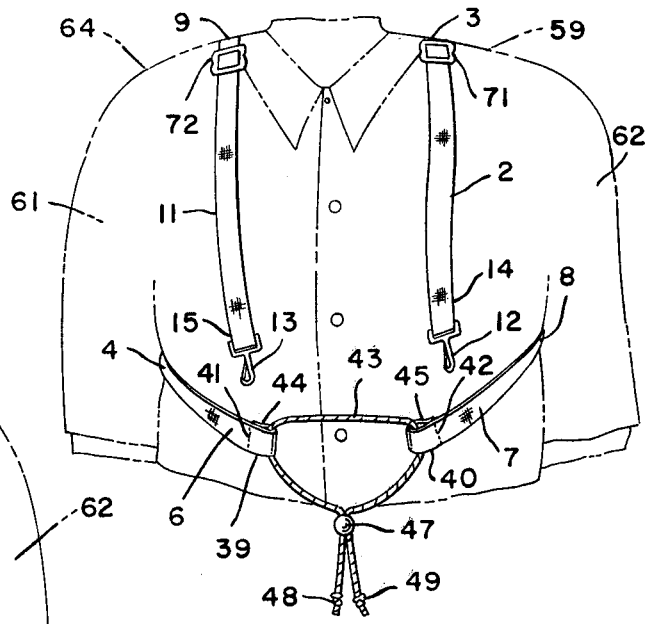
FIG. 7 is a front view of the holding means illustrated in FIG. 2.
Figure 8:
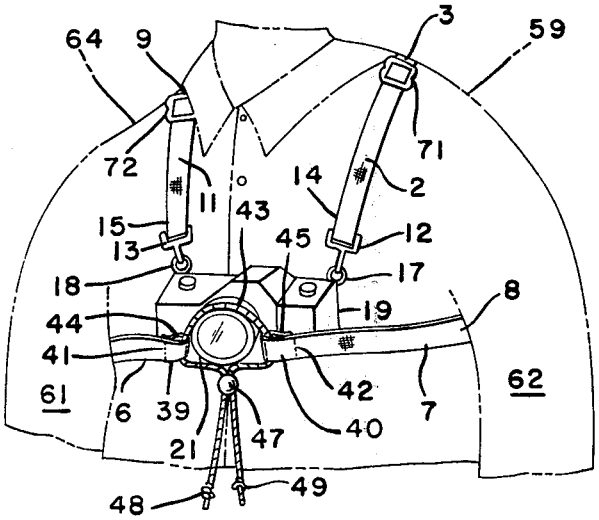
FIG. 8 is a front view of the harness and holding means illustrated in FIG. 7 attached to a camera.

Referring to FIGS. 2, 7 and 8, an alternate form of holding means 22' is illustrated. In this form of the invention, the transverse chest portion members 6 and 7 include a pair of transversely spaced attachment members and preferably, the attachment members consist of loops 39 and 40 in the strap formed by turning the strap under and sewing the ends of the strap as indicated at 41 and 42. An elongated member 43 such as a nylon cord is then slidably mounted within the spaced attachment members by threading the cord through the loops 44 and 45. A griping member 47 such as the type made by Progresco Company of Altadena, Calif. or by many others is then attached to the cord so that it holds two portions of the cord in side by side relationship at selected portions for adjusting the diameter of the loop formed by the elongated member. The ends of the cord should be formed in knots 48 and 49 to prevent them from slipping through the griping member 47 and permitting separation of the gripping member from the cord.

Figure 6:
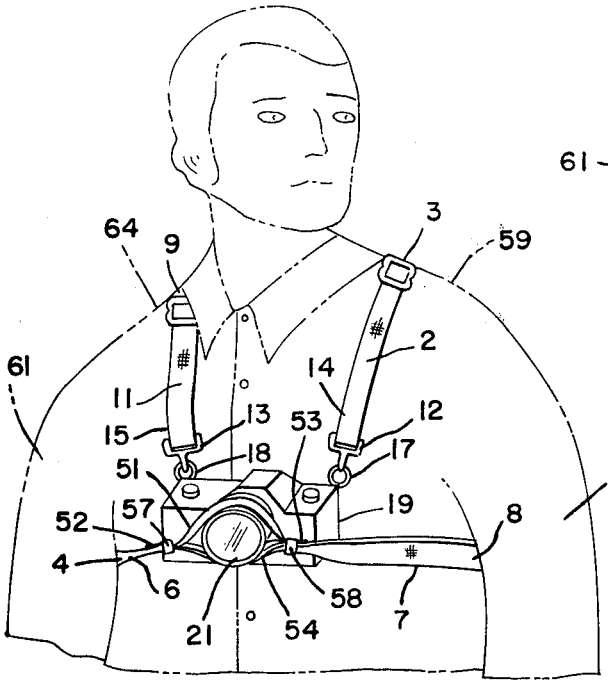
FIG. 6 is a front view of the harness of FIG. 4 attached to a camera.

Still another form of the invention is illustrated in FIGS. 1, 4 and 6. In this form of the invention, the holding means 22" includes an elongated cinch strap member 51 which has its ends 52 and 53 attached to the transverse chest extension portion 54 at horizontally spaced portions 55 and 56. The attachment may be accomplished by sewing the strap ends, stapling or other fastening means. A single slide member 57 may be mounted on the transverse chest portion or preferably a second slide member 58 is also attached to the strap. The slide members may be made of plastic or other suitable material, and constructed in the manner shown in FIG. 12. To prevent the slides from moving beyond the cinch strap a septum as illustrated in FIG. 11 may be incorporated in the slide. The septum, as previously discussed is placed in the opening between the harness strap and the cinch strap.

Each of the harnesses described is used to carry a camera or similar instrument which has at least one strap lug and a lens or other member which projects outwardly over which a loop made of webbing, cord or other strap material may be secured. Each of these harnesses is placed on the body using the following procedure. (1) Spring clip 12 at end 14 of the strap is attached to strap lug 17. On a camera using a split ring attached to the strap lug, the spring clip is attached to the split ring. (2) Holding the camera in the left hand close to the chest with lens pointed forwardly, the remainder of the harness strap is dropped over the left shoulder 59. (3) Reach behind your back with your right hand, grasp the strap and bring the transverse portions 6 and 7 of the strap under the right arm 61 and to the front of the chest. (4) Continue the motion of the right hand, carrying the strap, under the camera 19 under the left arm 62, diagonally across the back 63, over the right shoulder 64 and down to the camera at the front chest. (5) Attach the other coupling 13 to the strap lug 18 on the camera. (6) The holding means 22 is then attached to the barrel 21 of the camera as set forth by each form of the invention as described below.

Referring to FIGS. 3, 9, and 10, the barrel of the camera is placed through the slit 23 with portion 24 placed over the barrel and portion 25 placed under the barrel. Slides 27 and 28 are then pushed towards the barrel of the camera until the strap portions 24 and 25 hold the barrel securely. The friction of the strap portions 24 and 25 on the slide members 27 and 28 prevent the slides from moving along the strap, thereby holding the camera barrel firmly and securely therebetween. An unexpected result of the structure of the holding means is the fact that the weight of the camera itself causes the harness system to hold the camera even more tightly against the chest of the user. Referring to FIG. 10, it is noted that the barrel of the camera is slightly above the harness strap portions 4 and 8 as they pass under the arms. As the weight of the camera pulls downwardly on strap ends 14 and 15, tension is placed on all portions of the strap until portions 6 and 7 are placed in tension.

Tension on strap portions 6 and 7 causes the strap portions 24 and 25 not only to tighten more firmly about the camera barrel but also causes the strap portions 24 and 25 to pull the camera more firmly into the chest of the user.

Referring to FIGS. 2, 7 and 8, the holding means is operated in the following manner. The spring slide grip 47 is moved toward the ends 66 and 67 of the cord so that the cord can fit around the camera barrel. The spring slide grip is then slid away from the ends 66 and 67 until the cord is firmly and snugly around the lens barrel. Tightening the cord draws the ends of the strap with attachment members 39 and 40 towards the camera. The weight of the camera, both causes the cord 43 to more firmly grip the camera barrel lens and to hold the camera more closely to the chest of the user as described above.

Referring to FIGS. 1, 4, and 6, the holding means 22″ is operated in the following manner. The slides 57 and 58 are spread apart and the lens barrel is placed within the opening formed by straps 51 and 54. The slides are then moved toward one another until the lens barrel is firmly and snugly gripped by the straps. The friction of the diverging straps causes the slides to remain in position. The weight of the camera, both causes the straps to more firmly grip the camera barrel lens and to hold the camera more closely to the chest of the user as described above.

As may be understood from the description and operation of all of the forms of the present invention, the function of tightening the harness so that it is more securely held to the body, and the function of more tightly securing the harness to the camera are separate as opposed to the operation of the Kuban Hitch (unpatented) in which only the harness is tightened, and there is no separate tightening means of attaching the camera to the harness. In the present invention, the harness is tightened by moving strap adjustment members 71 and 72 away from the camera and the harness is loosened by moving the strap adjustment members toward the camera. Tightening of the harness will also cause the holding means to tighten slightly around the lens barrel and will cause the camera to be held more tightly against the chest.

With the functions of tightening the harness and tightening the holding means about the camera separated, the user may make the necessary adjustments for comfort and for holding the camera. Thus, it may be that the person would like to keep the harness snug around his body but he may wish the holding means to be loose so that he can easily and quickly free the camera from the holding means to take a picture. In other instances, it may not be necessary to have the harness fit tightly about the person, but for preventing the camera from separating from the harness, it may be desired to grip the camera very tightly in the harness. As stated above, the Kuban Hitch does not offer this flexibility. With the Kuban Hitch, both the harness and the gripping bands will be loose or they must both be tight.

A special advantage of the form of the invention illustrated in FIGS. 2, 7 and 8 is the fact that by increasing the size of the loop in the cord, the overall length of the strap may be varied greatly. This gives the user of the camera held by the harness, more length for inspection or manipulation of the settings on the camera. Further, since the cord may be made very small in diameter, the cord covers less of the settings than the straps of the other forms of the invention. The advantages of this form of the invention are most apparent in comparison with the Kuban Hitch in which the plurality of elastic rubber bands cover a good portion of the case. If the user of the Kuban Hitch is not concerned about the metal hardware damaging the surface finish of the camera or catching on the camera mechanism, he may directly hold the camera but most of the settings will be covered by the bands.

The present harness strap may be of the single strap type as illustrated in Brewer U.S. Pat. No. 3,884,403 and in this specification, or it may be a separable strap as described in Brewer U.S. Pat. No. 4,033,488 in which a portion of the harness strap is separable so that that the system may be used as either a harness or a simple neck strap.

Wherever the word camera and camera lens barrel have been used in this specification and in the claims, it is intended that the words are used in a generic rather than limited sense. For the purpose of this application the word "instrument" may be substituted for "camera" and the work "projection" for "lens barrel".

Still another optional slide 27″ is shown in FIG. 14. The slide may be made of plastic and includes a septum member 28″ which devides the inside openings into two (2) separate compartments 29″ and 30″. In use, the slide is used with the holding means illustrated in FIGS. 1, 4 and 6. The septum is placed in the opening between straps 51 and 54. The purpose of the septum is to prevent the slide member from moving along the harness strap beyond strap portions 55 56. Operation of the slide is identical to the slide shown in FIG. 11. The slide 27″ illustrated in FIG. 14 may be substituted for the slides designated 57 and 58 in FIGS. 1 and 4.

I claim:

1. A harness for carrying a camera or other instrument having a pair of apertured coupling elements (17) and (18) thereon wherein the harness is a flexible, non-elastic, elongated member (1) consisting of the following portions and have a length adapted to span the distance from the wearer's chest "first chest portion (2)", over one shoulder "first shoulder portion (3)", under the arm "first under arm portion (4)", across the chest"transverse chest portions (6) and (7)", under the second arm "second under arm portion (8)", over the second shoulder "second shoulder portion (9)", and back to the chest "second chest portion (11)", and a pair of releasable coupling members (12) and (13) are attached to the first and second ends (14) and (15) of said strap and are dimensioned to releasably couple to said apertured coupling elements on said camera 19; said improvement comprising:

a. instrument holding means including only flexible, non-elastic, elongated member portions connected to said transverse chest portions (6) and (7) forming an enlarged opening and adapted for loosely encircling and receiving the lens barrel (21) of said camera (19) and being movable to a position forming a restricted non-expanding opening for gripping said barrel in a close fitting embrace;

b. sliding grip means unattached to any selected portion of said harness and including a substantially non-elastic member encircling said holding means and having a first mode for free sliding movement along a portion of said non-elastic member portions and a second mode in frictional non-sliding gripping engagement with said non-elastic elongated member portions for gripping and holding two portions of said elongated member portions in side by side relationship at selected portions for selectively adjusting the diameter of the opening of said holding means encircling and gripping said camera lens barrel;

c. said holding means and said grip means are adapted for gripping said camera with a force which is independent of the tightness with which said harness holds said camera to the body of said wearer; and d. when said holding means is in said position forming a restricted opening there is little or no elongation of said transverse chest portions of said harness or relative movement between said camera and said chest portions of said harness.

2. A harness as described in claim 1 comprising:

a. said holding means includes an elongated slit (23) in said transverse chest portion; and b. said slide means includes a slide member (27) consisting only of an elongated sleeve member forming an opening having a shape and size for close fitting sliding relation with said transverse chest portion of said harness and mounted on said transverse chest portion for sliding movement thereon for adjusting the diameter of the opening of said holding means.

3. A harness as described in claim 2 comprising:

a. said slide means includes a pair of said slide members (27) and (28) mounted on said transverse chest portion.

4. A harness as described in claim 2 comprising:

a. said slide means consists of a tubular member (27') and a septum member (28) joining the sides of said tubular member; and b. said septum member is mounted to traverse said slit opening (23).

5. A harness for carrying a camera having a pair of apertured coupling elements (17) and (18) thereon wherein the harness is a flexible, non-elastic, elongated member (1) consisting of the following portions and having a length adapted to span the distance from the wearer's chest "first chest portion (2)", over one shoulder "first shoulder portion (3)", under the arm "first under arm portion (4)", across the chest "transverse chest portions (6) and (7)", under the second arm "second under arm portion (8)", over the second shoulder "second shoulder portion (9)", and back to the chest "second chest portion (11)", and a pair of releasable coupling members (12) and (13) are attached to the first and second ends (14) and (15) of said strap and are dimensioned to releasably couple to said apertured coupling elements on said camera (19), said improvement comprising:

a. holding means connected to said transverse chest portions (6) and (7) adapted for encircling the barrel (21) of said camera (19)

b. sliding grip means connected to said holding means for selectively adjusting the diameter of the opening of said holding means encircling and gripping said camera barrel;

c. said transverse chest portion member includes a pair of transversely spaced attachment members (39) and (40);

d. said holding means includes an elongated member portion (43) slidably mounted within said spaced attachment members; and e. said slide means includes a member (47) for gripping and holding two portions of said elongated member portion in side by side relationship at selected portions for adjusting the diameter of the opening formed by said elongated member.

6. A harness as described in claim 1 comprising:

a. said holding means includes an elongated cinch strap member (51) having its ends attached to said transverse chest portion at horizontally spaced portions; and b. said slide means includes a slide member mounted (57) for sliding movement on said transverse chest portion encircling said elongated cinch, strap member for adjusting the diameter of the opening formed between said transverse chest portion and said cinch strap member.

7. A harness as described in claim 6 comprising:

a. said slide means includes a pair of slide members (57) and (58) slidably mounted on said transverse chest portion; and b. each of said slide means includes a tubular member dimensioned to closely encircle said transverse chest portion and said cinch strap member and including a septum member dividing said slide into substantially equal compartments.

* * * * *